US007614926B2

(12) United States Patent
White et al.

(10) Patent No.: US 7,614,926 B2
(45) Date of Patent: Nov. 10, 2009

(54) MEANS FOR BEARING A PROPULSION UNIT AND A PROPULSION SYSTEM FOR A WATERBOURNE VESSEL

(75) Inventors: Richard Geoffrey White, Ulsteinvik (NO); Jan Stale Viddal, Ulsteinvik (NO)

(73) Assignee: Rolls-Royce Marine AS, Ulsteinvik (NO)

( * ) Notice: Subject to any disclaimer, the term of this patent is extended or adjusted under 35 U.S.C. 154(b) by 0 days.

(21) Appl. No.: 11/563,703

(22) Filed: Nov. 28, 2006

(65) Prior Publication Data

US 2007/0123118 A1 May 31, 2007

(30) Foreign Application Priority Data

Nov. 30, 2005 (NO) ..... 20055667

(51) Int. Cl.
*B63H 5/20* (2006.01)

(52) U.S. Cl. ..... 440/53

(58) Field of Classification Search ..... 440/53
See application file for complete search history.

(56) References Cited

U.S. PATENT DOCUMENTS

| | | | | |
|---|---|---|---|---|
| 3,734,050 | A | 5/1973 | Kitai | |
| 4,634,389 | A * | 1/1987 | Eptaminitakis | 440/53 |
| 5,324,560 | A | 6/1994 | Oblander et al. | |
| 2002/0025095 | A1 * | 2/2002 | Brandenstein et al. | 384/569 |

FOREIGN PATENT DOCUMENTS

| | | |
|---|---|---|
| DE | 1107550 | 5/1961 |
| DE | 3326415 | 2/1985 |
| EP | 159144 | 10/1985 |
| EP | 0590867 | 4/1994 |
| EP | 719900 | 7/1996 |
| EP | 0831026 | 3/1998 |
| WO | 8905262 | 6/1989 |
| WO | 01/81170 | 11/2001 |
| WO | 03093102 | 11/2003 |

OTHER PUBLICATIONS

EP search report.
EPO search report of Jun. 25, 2007.
Automatically generated translation of DE 1107550.

* cited by examiner

*Primary Examiner*—Stephen Avila
(74) *Attorney, Agent, or Firm*—Christian D. Abel

(57) ABSTRACT

A propulsion system 2 for a waterborne vessel 4 having a hull structure 6, typically for a full or semi planing boat. The propulsion system 2 has a pod housing 8 having a front end 10 and a rear end 12, a propeller 14 and a propeller shaft 16. The propeller 14 is disposed externally at the front end 10 of the pod 8 and is rotatable about a longitudinal axis 18of the propeller shaft 16, the propeller shaft 16 being drivingly connected to a drive assembly. The drive assembly has a transmission unit 20 and a power unit 22 in the form of a diesel engine. In FIG. 1 the diesel engine is shown disconnected from the transmission unit 20. The power unit 22 is disposed within the structure of the hull 6 and, in this particular embodiment; the transmission unit 20 is disposed substantially outside the structure of the hull 6. The hull 6 is formed with a port 24 through which an interface unit 26 extends. The interface unit 26 provides structures for transmitting the torque of the power unit 22 to the transmission unit 20.

7 Claims, 5 Drawing Sheets

MEANS FOR BEARING A PROPULSION UNIT AND A PROPULSION SYSTEM FOR A WATERBOURNE VESSEL

FIELD OF THE INVENTION

The present invention relates to means for bearing a propulsion unit and propulsion systems for waterborne vessels and concerns particularly, although not exclusively, with propulsion systems comprising azimuth propeller drive means for vessels.

BACKGROUND OF THE INVENTION

Known ship propulsion systems that include azimuth pod thrusters are conventionally mounted through the hull of the vessel. Azimuth thrusters are used in vessels of all sizes from ships to sports leisure boats. The thrusters are rotatable 360 degrees about a vertical axis and they are mounted to the vessel using a series of up to seven roller bearing assemblies. The thrusters may be a fixed distance from the hull or they may be retractable. The retractable thruster arrangement may be a "swing-up" action or a linear vertically retractable action. When using a series of roller bearings for the means of mounting, the overall distance of the series has to be of a certain length in order to retain a sufficient level of tolerance deviation. The necessary overall length of the series means that there is a reduced amount of area within the vessel. Alternative traditional propulsion systems include conventional transmission shafting and propellers with inclined shafts are usual. The construction of traditional propulsion systems leads to low efficiency and as a consequence, thereof also noise and levels of vibration will often be much higher than what is allowed for larger commercial vehicles. The reason for this is because the motors of the existing concepts have to be positioned forward in the boat in order to avoid too large inclination of the propeller shaft. Nevertheless, the inclination will lead to large propeller excitations as they are rotating.

The various aspects of the present invention set out to overcome the problems of the known systems by providing propulsion systems that utilize less overall space within a waterborne vessel than equivalent known propulsion systems and in particular to provide a system that requires a reduced amount of space, therefore providing more space within the waterborne vessel.

SUMMARY OF THE INVENTION

According to a first aspect of the present invention there is provided bearing means for a propulsion system for a waterborne vessel comprising a hull structure, the propulsion system comprises a rotatable outboard housing mounted to the vessel structure; turning means for turning the outboard housing about an axis; a propeller shaft rotatably supported on the housing; wherein the bearing means comprises a first pair of plain bearing surfaces that are in slidable contact with each other, one plain bearing surface forming part of the rotatable outboard housing and the other plain bearing surface forming part of the hull structure of the waterborne vessel, the arrangement being such that, in use, the first pair of plain bearing surfaces are in sliding contact as the outboard housing rotates about the axis.

It shall be appreciated that the term "forming part of the outboard housing" is used in this context to include an arrangement wherein the plain bearing surface may not necessarily form part of the actual outboard housing but may be secured to the housing and/or be disposed within the housing. Also, the term "forming part of the hull structure" is used in this context to include an arrangement wherein the plain bearing surface may not necessarily form part of the actual hull structure but may be secured to the hull structure and/or be disposed within the hull structure.

The plain bearing surfaces provide an improved bearing arrangement that allows the overall height of the propulsion system to be less than existing systems.

In an alternative embodiment of the first aspect of the present invention the bearing means comprises a first pair of plain bearing surfaces that are in slidable contact with each other, one plain bearing surface forming part of the rotatable outboard housing and the other plain bearing surface forming part of an intermediate housing of the hull structure of the waterborne vessel, the arrangement being such that, in use, the first pair of plain bearing surfaces are in sliding contact as the outboard housing rotates about the axis.

The plain bearing surfaces preferably extend in a direction away from the axis of rotation of the outboard housing.

The plain bearing surfaces preferably extend in a direction away from the axis of rotation of the outboard housing, the direction being substantially perpendicular to the axis of rotation of the outboard housing.

In an alternative arrangement of the respective bearing surfaces, one or both of the pair of surfaces are tapered or form frustro-conical shapes.

Preferably, the plain bearing surfaces extend substantially around the axis of rotation of the outboard housing.

Preferably, at least one of the plain bearing surfaces is a substantial annular shape.

Preferably, the bearing means comprises a second pair of plain bearing surfaces that are in slidable contact with each other, of which one plain bearing surface forms part of the rotatable outboard housing and the other plain bearing surface forms part of the hull structure of the waterborne vessel, the arrangement being such that, in use, the second pair of plain bearing surfaces are in sliding contact as the outboard housing rotates about the axis.

The second pair of plain bearing surfaces preferably extends substantially parallel with the axis of rotation of the outboard housing.

In an embodiment of the first aspect of the present invention, the plain bearing means comprises an annular element formed with the first plain bearing surface, wherein the first bearing surface is in sliding contact with the second plain bearing surface.

In a further alternative embodiment of the first aspect of the present invention, the first pair of plain bearing surfaces and/or the second pair of plain bearing surfaces comprises friction reducing means disposed between the plain bearing surfaces.

Preferably, friction reducing means comprises roller bearing means disposed between the plain bearing surfaces. The roller bearing means helps to reduce the friction between the respective bearing surfaces. The roller bearing means may comprises any one of the various known types of roller bearing arrangements but preferably the roller bearing means comprises needle roller bearings disposed between the plain bearing surfaces.

Preferably, the propulsion system comprises an azimuth unit. The azimuth unit may be a forward facing unit wherein the propeller is disposed at the front of the unit or a rearward facing unit wherein the propeller is disposed at the rear of the unit.

According to a second aspect of the present invention there is provided a propulsion system for a waterborne vessel comprising a hull structure, the propulsion system comprising, a pod housing having front and rear ends, a propeller and a propeller shaft, the propeller being disposed externally of the pod and being rotatable about a longitudinal axis of the propeller shaft, the propeller shaft being drivingly connected to drive means, the drive means comprising a transmission unit and a power unit, the power unit being disposed within the hull structure and the transmission unit being disposed at least partially outside the hull structure, the hull being formed with a port through which an interface unit between the transmission unit and the power unit may extend.

The interface unit may form part of the power unit but preferably the interface unit forms part of the transmission unit.

The location of at least a partial part of the transmission unit being outside of the hull means that the power unit may be positioned towards the aft of the hull thus providing more space within the hull. Also, the external positioning of the transmission unit provides for better access for assembly and maintenance of the unit.

Preferably the transmission unit comprises a gearing assembly for transferring the torque from the power unit to the propeller shaft, the power unit comprising an output shaft rotatable about a longitudinal axis, the gear assembly comprising a intermediate shaft rotatable about a longitudinal axis and respective gear sets to transmit motion between respective shafts at respective points at which longitudinal axis of the shafts intersect, the arrangement being such that the longitudinal axis of the power output shaft intersects the longitudinal axis of the intermediate shaft at a point above an intersection of the longitudinal axis of the intermediate shaft and the longitudinal axis of propeller shaft, and wherein the intermediate shaft of the transmission unit is disposed outside the hull structure.

Preferably, the gear set to transmit motion between the intermediate shaft and the propeller shaft is located outside the hull.

The gear set to transmit motion between the output shaft and the intermediate shaft is preferably located outside the hull.

Preferably, at least one of the gear sets comprises a number of bevel gears.

In a preferable embodiment of the invention the transmission unit is located substantially outside the hull.

The longitudinal axis of the power output shaft is preferably substantially horizontal.

Preferably, the longitudinal axis of the intermediate shaft is substantially vertical.

The longitudinal axis of propeller shaft is preferably substantially horizontal and substantially parallel to the longitudinal axis of the power output shaft.

The transmission unit is preferably attached to the hull of the vessel.

The transmission unit preferably comprises a housing that is attached to the stern of the hull.

In a preferred embodiment of the present invention, the propulsion system comprises steering means for the vessel, whereby in use the steering means alters the direction of the propeller.

In a particular arrangement of the present invention the power unit is disposed adjacent a lowermost aft region of the hull.

The power unit is preferably disposed on a support frame within the vessel.

The support frame preferably comprises a planar section formed with a hole, the arrangement being such that, in the assembled state, the planar section is mounted to the stern of the vessel and the power output shaft extends through the hole formed in the planar section.

According to a third aspect of the present invention there is provided drive means for a waterborne vessel comprising a hull structure, the drive means comprising a transmission unit and a power unit, the power unit being disposed within the hull structure and the transmission unit being disposed at least partially outside the hull structure, the hull being formed with a port through which an interface unit between the transmission unit and the power unit may extend.

The drive means is used to power a propeller of the vessel. Preferably, the drive means powers an azimuth propeller assembly.

It shall be appreciated that one or more of the features described above regarding the second and third aspects of the invention may be used in conjunction with the features of the first aspect of the invention. It shall also be appreciated that the invention may also comprise one or more of the features described below and/or shown in the accompanying Figures.

BRIEF DESCRIPTION OF THE DRAWINGS

A specific embodiment of the present invention and variants thereof will now be described by way of example only with reference to the accompanying drawings, in which.

DETAILED DESCRIPTION OF THE INVENTION

Existing propulsion systems known as azimuth thrusters use roller bearings to provide axial and radial bearing functionality so a thruster can be steered about a vertical axis to deliver propeller thrust in any desired horizontal direction (azimuthing). To support this bearing functionality, the roller bearings need a minimum distance between the respective bearing sets, which in this case will increase the total height of the inboard part, and in many cases will interfere with the ship structure. Azimuth thrusters may comprise pulling type propellers or pushing type propellers. The basic idea for an azimuth thruster is that the propeller can be rotated 360 degrees around the vertical axis, thus providing omni-directional thrust. The flexibility of azimuth thrusters may be used for a wide range of vessels.

Typical azimuth thrusters have mechanical drive systems using bevel gears at the top and bottom of a leg housing. Power is fed to the unit through a horizontal input shaft with the hull of the vessel and the unit incorporates steering motors for steering the thruster (azimuthing).

There are two main aspects to the present invention. The first concerns the use of a plain bearing arrangement for supporting a thruster and the second concerns the location of the mounting of a thruster. In a first embodiment of the invention, the thruster is mounted through the stern or transom of the vessel (see FIGS. 1 to 4).

In a second embodiment of the invention, the thruster is mounted through the hull of a vessel (see FIGS. 5 to 9).

Figure 1:
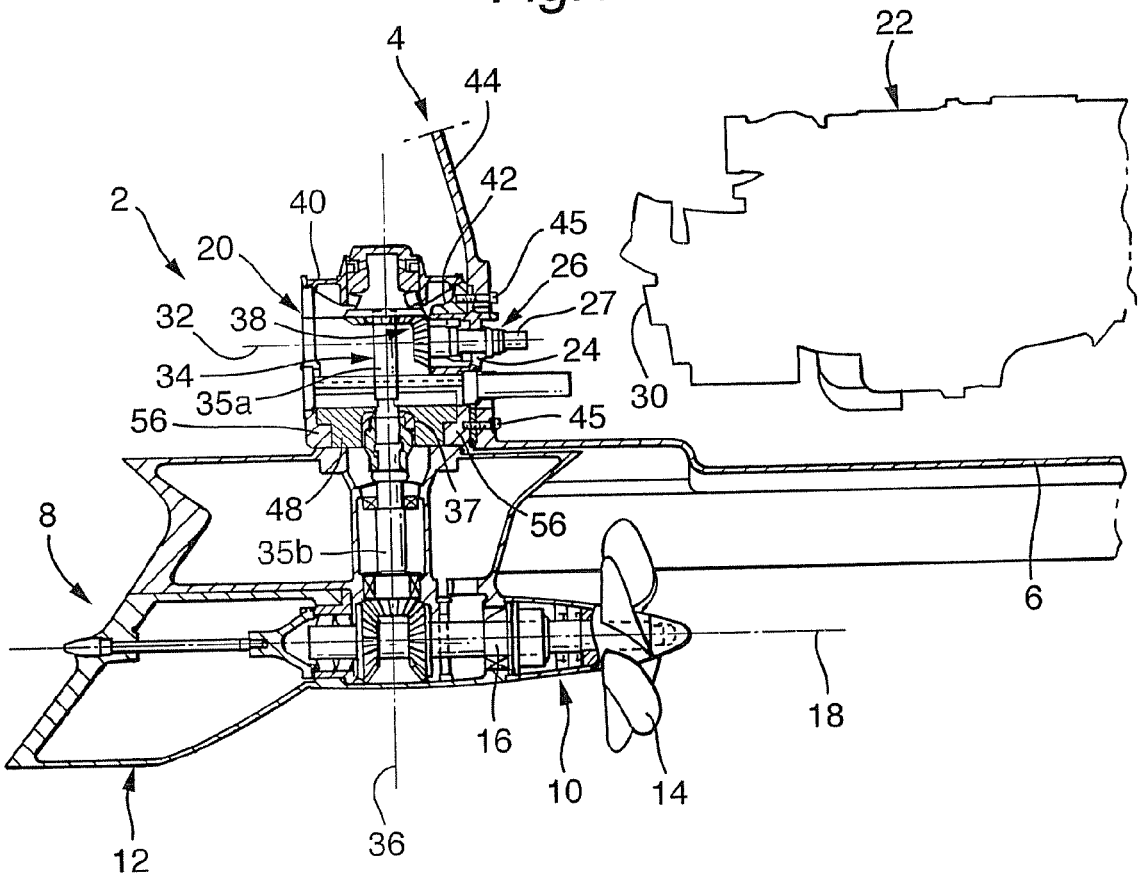
FIG. 1 is a partial cross section through an aft section of a vessel and a propulsion system and shows a power unit in a disconnected condition.

With reference to FIG. 1, there is shown one embodiment of a propulsion system according to the present invention that sets out to help overcome the problems of the previously known thrusters. The FIG. 1 shows a propulsion system 2 for a waterborne vessel 4 comprising a hull structure 6, typically for a full or semi-planing boat. The propulsion system 2 comprises a pod housing 8 having a front end 10 and a rear end 12, a propeller 14 and a propeller shaft 16. The propeller 14 is disposed externally at the front end 10 of the pod 8 and is rotatable about a longitudinal axis 18 of the propeller shaft 16, the propeller shaft 16 being drivingly connected to drive means. The drive means comprises a transmission unit 20 and a power unit 22 in the form of a diesel engine. In FIG. 1 the diesel engine is shown disconnected from the transmission unit 20. The power unit 22 is disposed within the structure of the hull 6 and, in this particular embodiment; the transmission unit 20 is disposed substantially outside the structure of the hull 6. The hull 6 is formed with a poll 24 through which an interface unit 26 extends. The interface unit 26 provides means to transmit the torque of the power unit 22 to the transmission unit 20.

The interface unit 26 may form part of the power unit but preferably the interface unit 26 forms part of the transmission unit 20. The interface unit 26 comprises a rotatable shaft 27, one end of which is connectable to the power unit 22 and the other end of which is connectable to one part of a gear set 38.

The transmission unit 20 comprises a gearing assembly for transferring the torque from the power unit 22 to the propeller shaft 16. The power unit 22 comprises an output shaft 30 rotatable about a longitudinal axis 32 when connected to the interface unit 26.

The gear assembly comprises an intermediate shaft 34 rotatable about a longitudinal axis 36 and respective gear sets 38 to transmit motion between respective shafts at respective points at which longitudinal axis of the shafts intersect. The arrangement is such that the longitudinal axis 32 of the power output shaft 30 intersects the longitudinal axis 36 of the intermediate shaft 34 at a point above an intersection of the longitudinal axis 36 of the intermediate shaft 34 and the longitudinal axis 18 of propeller shaft 16, wherein the intermediate shaft 34 of the transmission unit 20 is disposed outside the hull structure 6.

The propulsion system may typically comprise a power unit of 780 kW, but this solution can be used for substantially larger power output units than this.

The propulsion system 2 is based on a pulling propeller, a concept which is taken from a recently developed 'azimuth' concept, but adapted to the requirements which are typical for this market segment. This is dirigible 360 degrees or it can also be limited to a predetermined angle which for instance is plus or minus 5 degrees. The lower pod 8 is dirigible about the axis 36.

The object with using a pulling propeller is that it makes it possible to use an installation which increases the efficiency as it works in undisturbed in-streaming water, and that the interaction of the propeller beam with the vertical stem increases the total efficiency of the system. This leads also to a reduction of the noise and level of vibration, both what is induced from the propeller direct to the hull and what is normally transferred through the propeller shaft and out into the structure of the hull. In addition, the azimuth concept will help to increase maneuverability.

The transmission unit 20 comprises a housing 40 formed with a flange 42 which is connected to the stern 44 of the hull 6 by a series of bolts 45. The intermediate shaft 34 comprises two shafts sections, an upper section 35*a* disposed in the housing 40 and a lower section 35*b* disposed in the pod 8. The sections 35*a* and 35*b* are connected together by a coupling joint 37; this means that the power unit 22 can be placed as far back to the stern 44 as possible. This has the advantage for the boat designer with respect to selection of new solutions as the volume in which the power unit 22 would normally be positioned using conventional shaft drives. The extra space can be used for other and more attractive purposes. This will also improve the acoustic situation as the propulsion system can be placed far back in the boat. In addition, this will also make it possible to isolate the machine room in an effective way and to a lower cost than what is the situation with conventional shaft drive installations.

The advantage for the building yard by this invention is that the propulsion system can be mounted in a simple way at the end of the building period and that the interface between the power unit (diesel engine) of the propulsion system will be more simple and easier to overview. This solution also makes it easier to undertake repairs as the whole assembly is easily disassembled, even when the boat lies in the sea.

With reference to FIG. 1, the propulsion system 2 comprises a steering unit (not shown) which makes it possible to turn the pod 12 around a vertical axis so that the wanted steering efficiency is achieved. This can in principal work as a free rotating bearing 48 by n×360 degrees in both directions, or in a fast steering angle in both directions as for instance of plus or minus 45 degrees from straight ahead.

The propulsion system 2 comprises bearing means in the form of an annular plain bearing 48 connected to the rotatable pod housing 8 and an annular ring 56 that forms part of the transmission unit 20. The bearing means comprises a first pair and a second pair of bearing surfaces. The first pair of bearing surfaces extends is a radial direction from the axis 36. The second pair of bearing surfaces extend in a direction substantially parallel to the axis 36. The respective elements of the first and second pairs of bearing surfaces are formed respectively on the annular bearing 48 and the annular ring 56, the arrangement being such that, in use, the respective first and second pairs of plain bearing surfaces are in sliding contact as the pod housing 8 rotates about the axis 36.

The annular bearing 48 comprises a lower tubular section and an integral upper flange section. The annular bearing 48 is formed with a circular hole that extends through the longitudinal length and along the axis 36. One of the plain bearing surfaces of the first pairs is formed on a lower surface of the upper flange. This plain bearing surface extends in a direction away from the axis 36 of rotation of the pod housing 8. This plain bearing surface extends around the axis 36 of rotation of the pod housing 8.

The annular ring 56 comprises a lower annular section and an integral upper tubular section. The lower annular section is formed with a circular hole that is adapted to receive the lower tubular section of the annular bearing 48. The lower annular section of the ring 56 comprises the other plain bearing surface of the first pair of plain bearing surfaces. This other plain bearing surface of the first pair extends substantially in a direction away from the axis 36 of rotation of the pod housing 8. One of the second pairs of plain bearing surfaces is formed on a radially outermost surface of the lower tubular section. This plain bearing surface also extends in a direction substantially parallel to the axis 36. The plain bearing surface extends around the axis 36 of rotation of the pod housing 8.

The lower annular section of the ring 56 comprises the other plain bearing surface of the second pair of plain bearing surfaces. This other plain bearing surface of the second pair also extends in a direction substantially parallel to the axis 36. The other plain bearing surface extends around the axis 36 of rotation of the pod housing 8.

The first pair of plain bearing surfaces, which extends is a radial direction from the axis 36, provides bearing means for forces in an axial direction. The second pair of plain bearing surfaces, which extend in a direction substantially parallel to the axis 36, provides bearing support means for forces in a radial direction.

The first and second pairs of plain bearing surfaces provide an improved bearing arrangement that allows the overall height of the propulsion system to be less than existing systems.

The rotation of the pod housing 8 is achieved using a hydraulic cylinder. There are also positioned slots for transferring the axial movement of the hydraulic cylinder to a rotational movement which is used for the steering. The lower part of the annular bearing 48 is made of the housing of a top gear against an upper part of the propulsion system 2. As these are parts which are produced from cast iron, it is necessary to provide a bearing ring either of plastic material or the material of the type "Glacier", which is well known in the industry.

There is also provided sealing rings to prevent the ingress of seawater. Such sealing ring are known in the industry, but in this embodiment, there is provided an extra ring in order to improve the security against water.

Another embodiment is to provide a gear rim connected to the rotating upper part of the bearing with a corresponding pinion wheel which is driven by a hydraulic or an electric motor.

The bearing is lubricated in a usual way by using the available system oil in the upper angle gear.

By selecting this solution for the bearing, the overall height for the upper angle gear 38 will be reduced and thereby there is achieved a smaller distance between the output shaft 30 of the power unit 22 and the longitudinal axis 18 of propeller shaft 16. This means that it is possible to position the power unit 22 lower in the vessel which also has an advantages effect on the room conditions and the stability of the vessel. In addition, this solution will assist in reducing the complex ability of the propulsion system in form of a smaller number of parts and easier mounting of the bearing.

Figure 2:
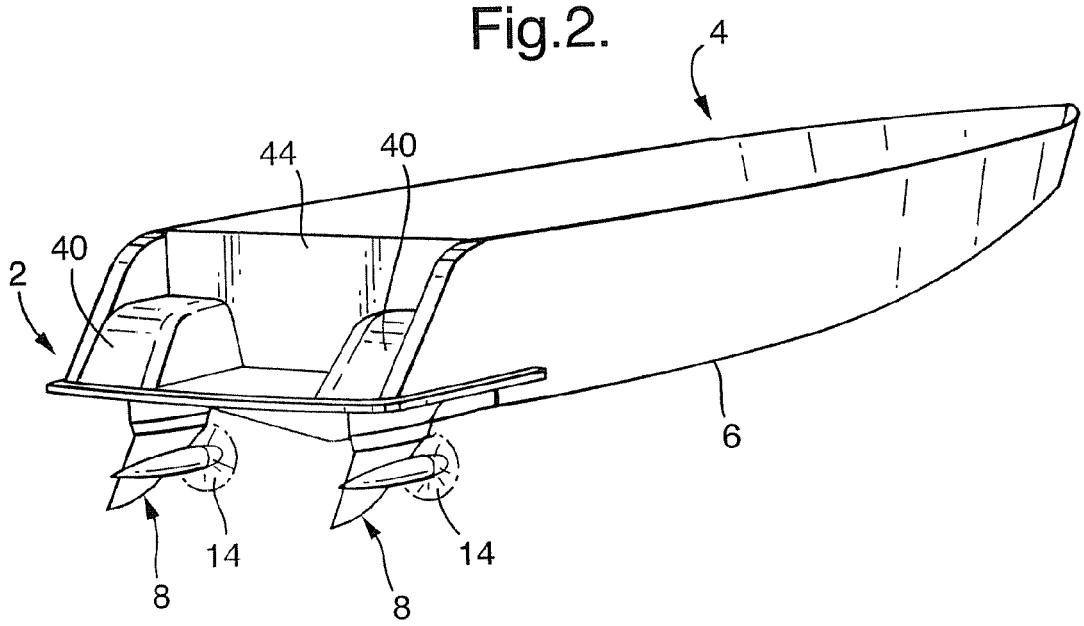
FIG. 2 is a perspective view of a vessel hull and lower elements of a propulsion system.

With reference to FIG. 2, there is shown a typical hull 6 of about 65 feet in length and two propulsion systems 2. The Figure illustrates how the pods 8 and the transmission units 22 may be positioned in the stern of the hull 6.

Figure 3:
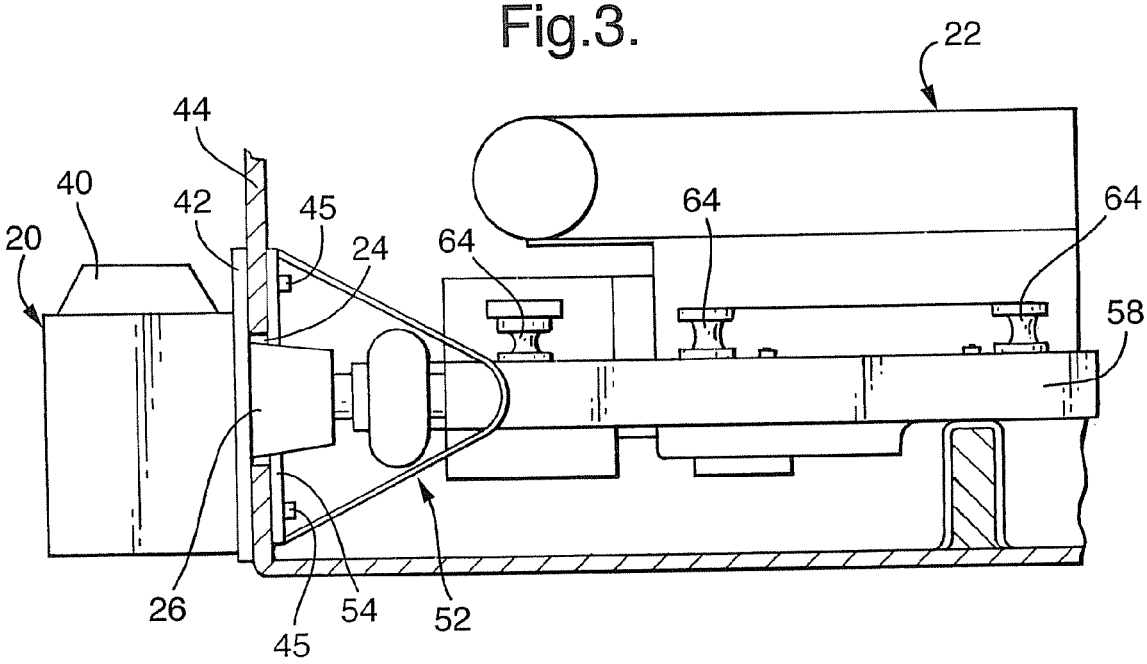
FIG. 3 is a side view of a support frame for the power unit and shows a transmission unit of the propulsion system.
Figure 4:
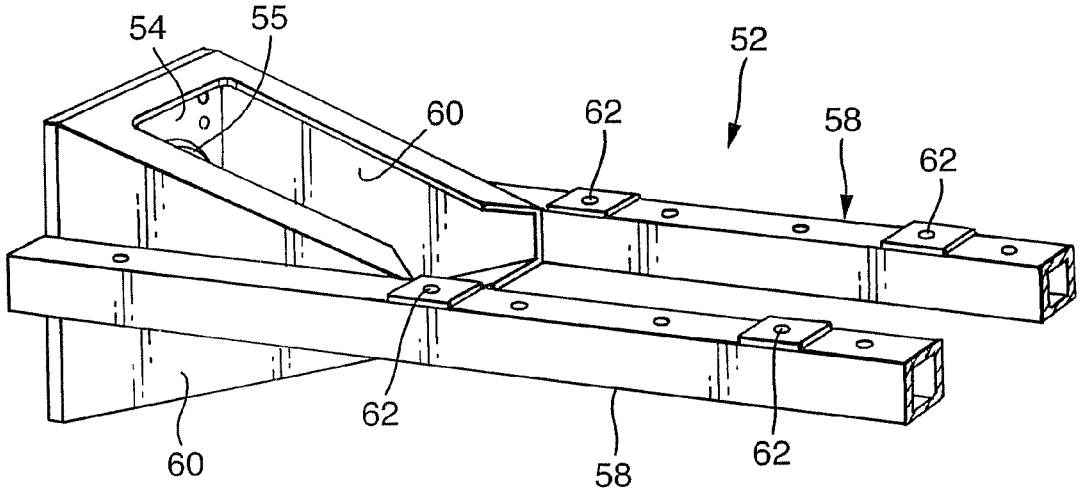
FIG. 4 is a perspective view of the support frame shown in FIG. 3 for the power unit.

With reference to FIGS. 3 and 4, there is shown a support frame 52 on which the power unit 22 is mounted. The support frame 52 comprises a square planar section 54 formed with a hole 55; two square tubular box sections 58 that each extend in a direction away from respective sides of the planar section 54; and two side flange sections 60. The tubular box sections 58 are formed with bolt holes 62 that are use to secure the power unit 22, via vibration damping mounts 64, to the frame 52. The arrangement of the support frame 52 is such that, in the assembled state, the planar section 54 is mounted to the stern 44 of the vessel and the rotatable shaft 27 extends through the hole 55. The planar section 54 helps to provide additional strengthening for the vessels stern 44.

Figure 5:
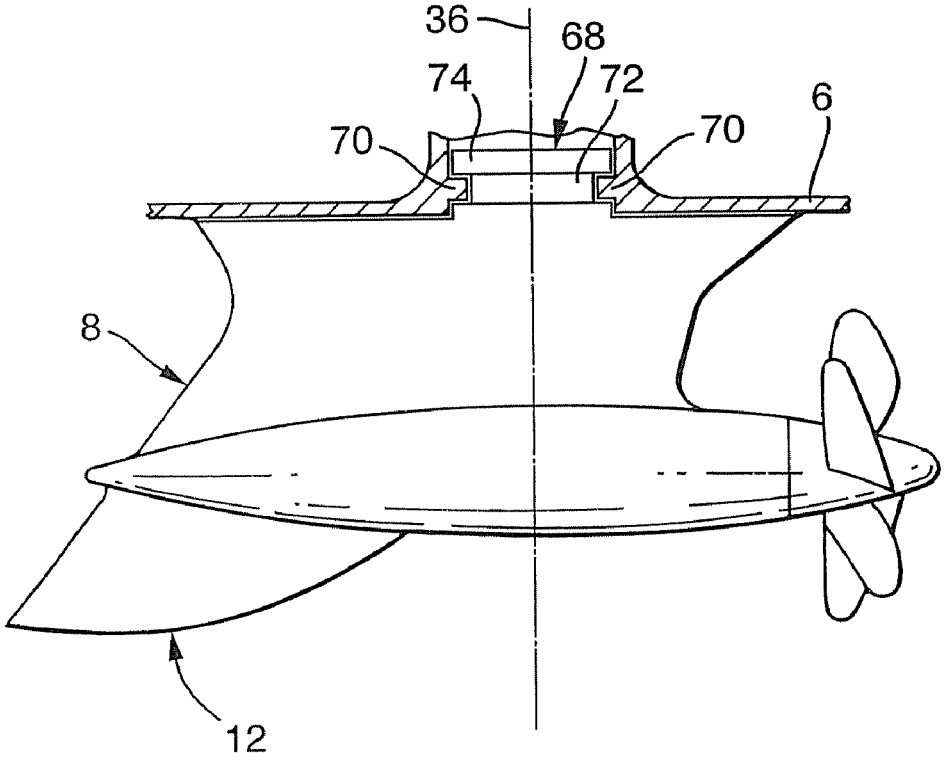
FIG. 5 is a side view showing an alternative bearing arrangement for a propulsion system.
Figure 6:
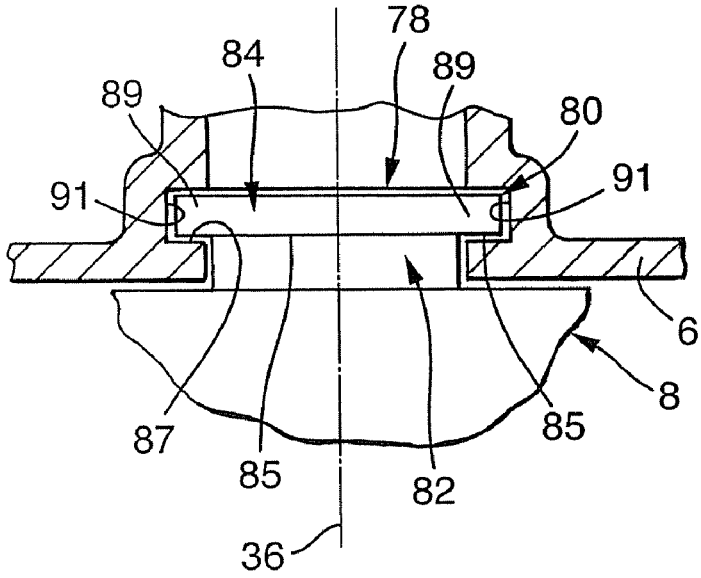
FIG. 6 is side view of a further alternative bearing arrangement for a propulsion system.
Figure 7:
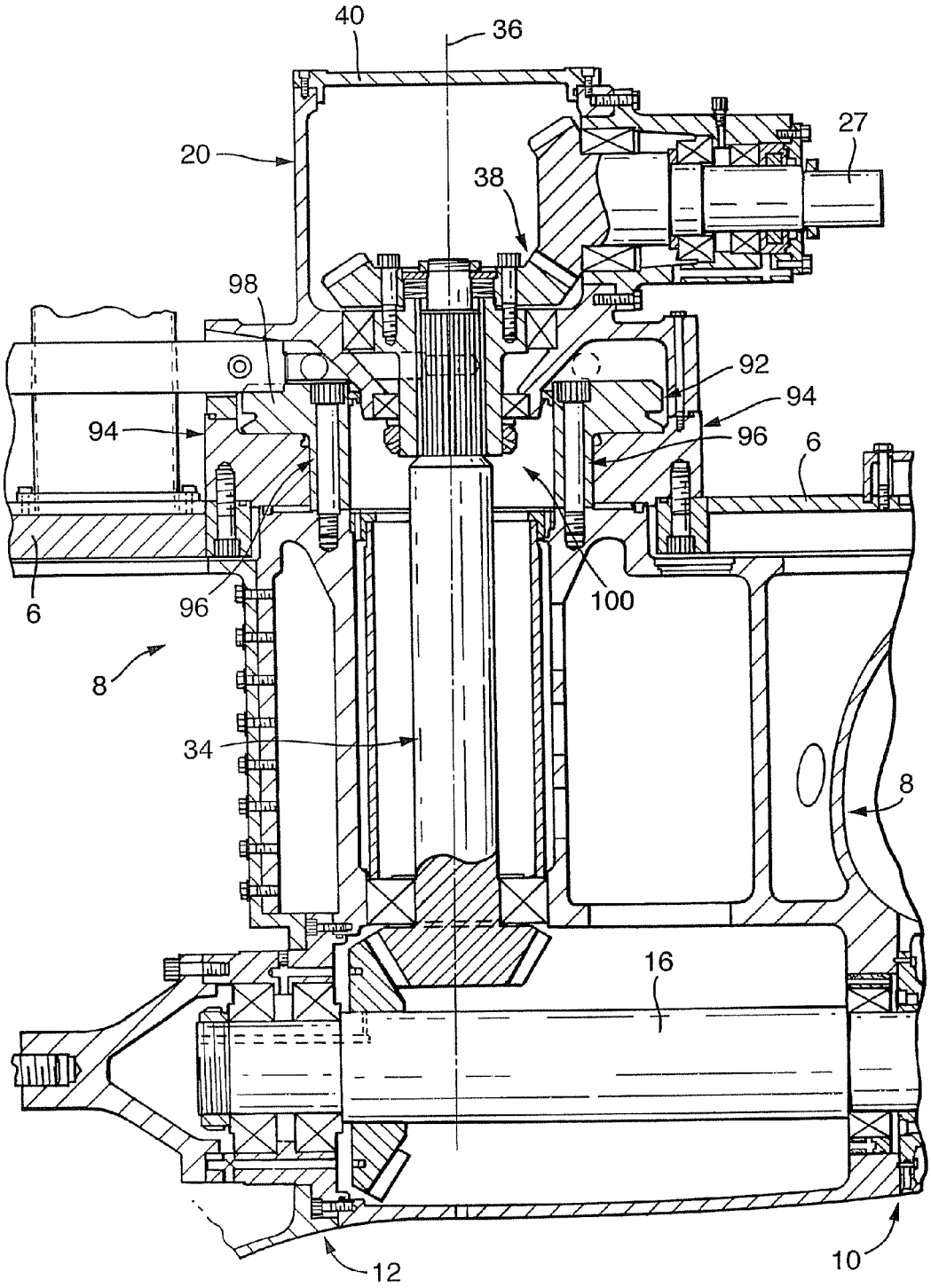
FIG. 7 is a partial cross section through an aft section of a vessel and a propulsion system and shows a further alternative bearing arrangement that extends through the hull of a vessel.

With reference to FIGS. 5, 6 and 7, there is shown three alternative forms of the bearing means for a thruster pod 8. In these embodiments, the thruster pod 8 is mounted directly through the hull 6 of the vessel. The internal drive arrangement of the pod 8 is substantially as described above.

FIG. 5 shows a bearing means similar to that shown in FIG. 1. The bearing means in FIG. 5 is in the form of an annular plain bearing 68 connected to the rotatable pod housing 8 and an annular ring 70 that forms part of the hull 6 of the vessel. The bearing means comprises a first and second pair of bearing surfaces.

The first pair of bearing surfaces extends in a radial direction from the axis 36. The second pair of bearing surfaces extend in a direction substantially parallel to the axis 36. The respective elements of the first and second pairs of bearing surfaces are formed respectively on the annular bearing 68 and the annular ring 70, the arrangement being such that, in use, the respective first and second pairs of plain bearing surfaces are in sliding contact as the pod housing 8 rotates about the axis 36.

In an alternative arrangement of the respective bearing surfaces, one or both of the pair of surfaces are tapered or form frustro-conical shapes. In an embodiment of this alternative arrangement, the first and second pairs of bearing surfaces may be replaced by a single pair of bearing surfaces forming a frustro-conical shape. The single pair of bearing surfaces will have a horizontal cross-section that narrows as the surfaces extend downwardly towards the axis 36.

The annular bearing 68 comprises a lower tubular section 72 and an integral upper flange section 74. The annular bearing 68 is formed with a circular hole (not shown) that extends through the longitudinal length and along the axis 36. One of the plain bearing surfaces of the first pairs is formed on an axially lower surface of the upper flange 74. This plain bearing surface extends in a direction away from the axis 36 of rotation of the pod housing 8, and this plain bearing surface extends around the axis 36 of rotation of the pod housing 8.

The annular ring 70 is adapted to receive the lower tubular section 72 of the annular bearing 68. An axially upper surface of the ring 70 comprises the other plain bearing surface of the first pair of plain bearing surfaces. This other plain bearing surface of the first pair extends substantially in a direction away from the axis 36 of rotation of the pod housing 8.

One of the second pairs of plain bearing surfaces is formed on a radially outermost surface of the lower tubular section 72. This plain bearing surface also extends in a direction substantially parallel to the axis 36. The plain bearing surface extends around the axis 36 of rotation of the pod housing 8.

A radially innermost surface of the annular ring 70 comprises the other plain bearing surface of the second pair of plain bearing surfaces. This other plain bearing surface of the second pair also extends in a direction substantially parallel to the axis 36. The other plain bearing surface extends around the axis 36 of rotation of the pod housing 8.

The first pair of plain bearing surfaces, which extends is a radial direction from the axis 36, provides bearing means for forces in an axial direction. The second pair of plain bearing surfaces, which extend in a direction substantially parallel to the axis 36, provides bearing support means for forces in a radial direction.

FIG. 6 shows an alternative bearing means to that shown in FIG. 1. The bearing means in FIG. 6 is in the form of an annular plain bearing 78 connected to the rotatable pod housing 8 and an annular channel 80 that forms part of the hull 6 of the vessel.

The bearing means comprises a first and second pair of bearing surfaces. The first pair of bearing surfaces extends is a radial direction from the axis 36. The second pair of bearing surfaces extend in a direction substantially parallel to the axis 36. The respective elements of the first and second pairs of bearing surfaces are formed respectively on the annular bearing 78 and the annular channel 80, the arrangement being such that, in use, the respective first and second pairs of plain bearing surfaces are in sliding contact as the pod housing 8 rotates about the axis 36.

The annular bearing 78 comprises a lower tubular section 82 and an integral upper flange section 84. The annular bearing 78 is formed with a circular hole (not shown) that extends through the longitudinal length and along the axis 36. One of the plain bearing surfaces of the first pairs is formed on an axially lower surface 85 of the upper flange 84. This plain bearing surface 85 extends in a direction radially away from the axis 36 of rotation of the pod housing 8, and this plain bearing surface 85 extends around the axis 36 of rotation of the pod housing 8.

The annular channel 80 is adapted to receive the flange section 84 of the annular bearing 78. An axially lower surface 87 of the channel 80 comprises the other plain bearing surface of the first pair of plain bearing surfaces. This other plain bearing surface 87 of the first pair extends substantially in a direction away from the axis 36 of rotation of the pod housing 8.

One of the second pairs of plain bearing surfaces is formed on a radially outermost surface 89 of the upper flange section 84. This plain bearing surface also extends in a direction substantially parallel to the axis 36. The plain bearing surface extends around the axis 36 of rotation of the pod housing 8.

A radially outermost surface 91of the annular channel 80 comprises the other plain bearing surface of the second pair of plain bearing surfaces. This other plain bearing surface 91 of the second pair also extends in a direction substantially parallel to the axis 36. The other plain bearing surface extends around the axis 36 of rotation of the pod housing 8.

The first pair of plain bearing surfaces, which extends is a radial direction from the axis 36, provides bearing means for forces in an axial direction. The second pair of plain bearing surfaces, which extend in a direction substantially parallel to the axis 36, provides bearing support means for forces in a radial direction.

FIG. 7 shows a further alternative bearing means to that shown in FIG. 1. The bearing means in FIG. 7 is in the form of an annular plain bearing 92 connected to the rotatable pod housing 8 and an annular ring 94 that is connected to the hull 6 of the vessel. This embodiment also comprises many features that are similar to the embodiment shown in FIG. 1 and described above. Therefore, the same reference numbers been used to indicate such similar features.

The bearing means shown in FIG. 7 comprises a first and second pair of bearing surfaces. The first pair of bearing surfaces extends is a radial direction from the axis 36. The second pair of bearing surfaces extend in a direction substantially parallel to the axis 36. The respective elements of the first and second pairs of bearing surfaces are formed respectively on the annular bearing 92 and the annular ring 94, the arrangement being such that, in use, the respective first and second pairs of plain bearing surfaces are in sliding contact as the pod housing 8 rotates about the axis 36.

The annular bearing 92 comprises a lower tubular section 96 and an integral upper flange section 98. The annular bearing 92 is formed with a circular hole 100 that extends through the longitudinal length and along the axis 36. One of the plain bearing surfaces of the first pairs is formed on an axially lower surface of the upper flange 98. This plain bearing surface extends in a direction radially away from the axis 36 of rotation of the pod housing 8, and this plain bearing surface extends around the axis 36 of rotation of the pod housing 8.

The annular ring 94 is adapted to receive the tubular section 96 of the annular bearing 92. An axially upper surface of the ring 94 comprises the other plain bearing surface of the first pair of plain bearing surfaces. This other plain bearing surface of the first pair extends substantially in a direction away from the axis 36 of rotation of the pod housing 8.

One of the second pairs of plain bearing surfaces is formed on a radially outermost surface 89 of the tubular section 96. This plain bearing surface also extends in a direction substantially parallel to the axis 36. The plain bearing surface extends around the axis 36 of rotation of the pod housing 8.

A radially innermost surface the annular ring 94 comprises the other plain bearing surface of the second pair of plain bearing surfaces. This other plain bearing surface of the second pair also extends in a direction substantially parallel to the axis 36. The other plain bearing surface extends around the axis 36 of rotation of the pod housing 8.

The first pair of plain bearing surfaces, which extends is a radial direction from the axis 36, provides bearing means for forces in an axial direction. The second pair of plain bearing surfaces, which extend in a direction substantially parallel to the axis 36, provides bearing support means for forces in a radial direction.

In an alternative embodiment of the present invention, the first pair of plain bearing surfaces and/or the second pair of plain bearing surfaces comprises friction reducing means disposed between the plain bearing surfaces. The friction reducing means may comprise roller bearing means disposed between the plain bearing surfaces. Alternatively, the friction reducing means may comprise static or hydrodynamic bearing fluid disposed between the plain bearing surfaces. The roller bearing means helps to reduce the friction between the respective bearing surfaces. The roller bearing means may comprises any one of the various known types of roller bearing arrangements but preferably the roller bearing means comprises needle roller bearings disposed between the plain bearing surfaces. The needle roller bearings are disposed circumferentially around the axis of rotation of the pod housing.

Figure 8:
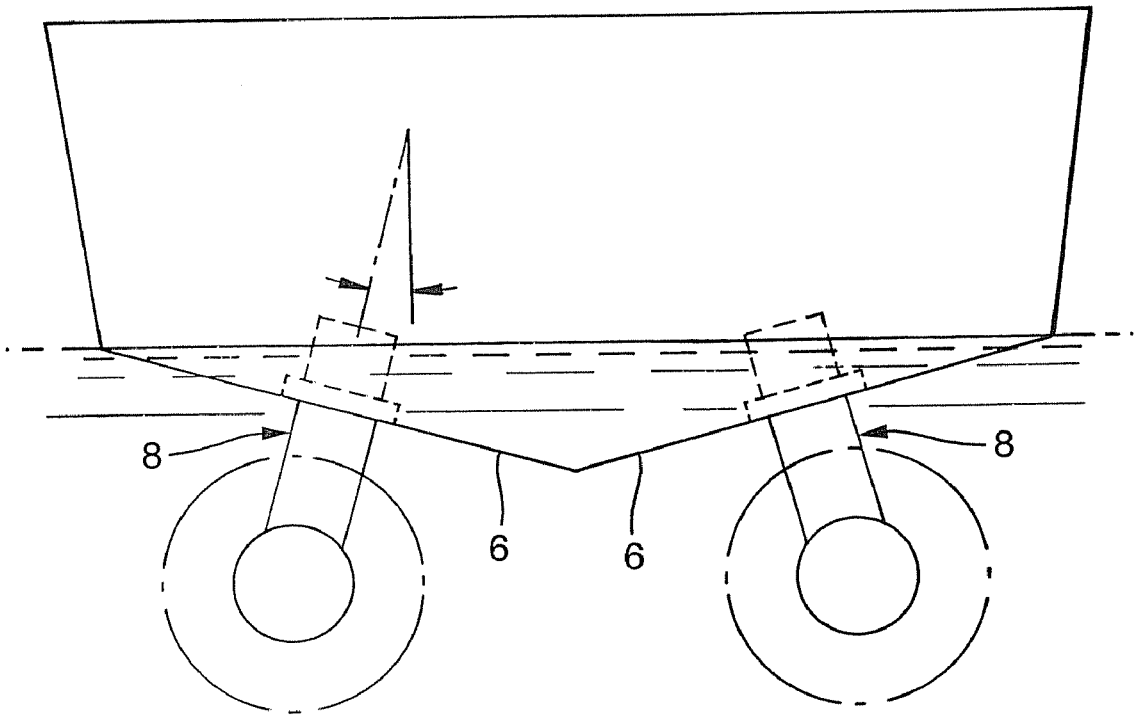
FIG. 8 is a rear view of a vessel comprising two propulsion units.
Figure 9:
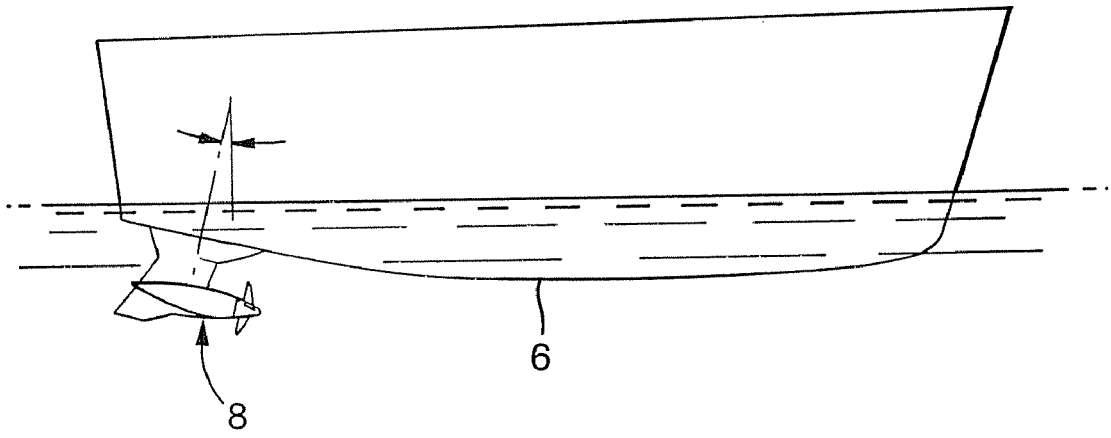
FIG. 9 is a side view of a vessel comprising a propulsion unit.

With reference to FIGS. 8 and 9, there is shown a typical arrangement of a thruster pod 8 that is mounted through the hull of a vessel according the present invention.

The invention claimed is:

1. A bearing arrangement for a propulsion system for a waterborne vessel comprising a hull structure, the propulsion system comprising a rotatable outboard housing mounted to the hull structure; said housing comprising a bearing member, a turning assembly for turning the outboard housing about an axis; a propeller shaft rotatably supported on the housing; wherein the bearing arrangement comprises a first pair of plain bearing surfaces that are in slidable contact with each other, said first pair of surfaces extending in a plane substantially perpendicular to the axis of rotation, wherein one plain bearing surface of said first pair is part of the bearing member and the other plain bearing surface of the first pair is a part of the hull structure, and wherein the bearing arrangement further comprises a second pair of bearing surfaces arranged in the substantially longitudinal direction of the axis of rotation, one surface of said second pair being a part of the bearing member and the other surface of the second pair being a part of the hull structure, the arrangement being such that, in use, at least one of the pairs of plain bearing surfaces is in sliding contact with each other as the outboard housing rotates about the axis.

2. A bearing arrangement as claimed in claim 1, wherein the plain bearing surfaces extend substantially around the axis of rotation of the outboard housing.

3. A beating arrangement as claimed in claim 1, wherein the second pair of plain bearing surfaces extend substantially parallel with the axis of rotation of the outboard housing.

4. A bearing arrangement as claimed in claim 3, wherein at least one of the plain bearing surfaces is a substantial annular shape.

5. A bearing arrangement as claimed in claim 1, wherein the plain bearing arrangement comprises an annular element formed with the first and second pair of plain bearing surface.

6. A bearing arrangement as claimed in claim 1, wherein the propulsion system comprises an azimuth unit.

7. A bearing arrangement as claimed in claim 6, wherein the azimuth unit is a forward facing unit wherein the propeller is disposed at the front of the unit or a rearward facing unit wherein the propeller is disposed at the rear of the unit.

* * * * *